US005891004A

United States Patent [19]

Berry

[11] Patent Number: 5,891,004

[45] Date of Patent: Apr. 6, 1999

[54] APPARATUS FOR CONTINUOUSLY VARYING THE RESISTANCE FORCE OF A WEIGHT TRAINING DEVICE

[76] Inventor: Michael W. Berry, 5448 N. 13th St., Milwaukee, Wis. 53209

[21] Appl. No.: 997,751

[22] Filed: Dec. 24, 1997

[51] Int. Cl.[6] ..... A63B 21/04; A63B 21/072

[52] U.S. Cl. ..... 482/129; 482/106

[58] Field of Search ..... 482/93, 94, 99, 482/106–109, 121–123, 129, 130

[56] References Cited

U.S. PATENT DOCUMENTS

| | | |
|---|---|---|
| 725,876 | 4/1903 | Roche . |
| 4,832,334 | 5/1989 | Mullen . |
| 5,029,849 | 7/1991 | Nurkowski . |
| 5,125,649 | 6/1992 | Fuller . |
| 5,346,448 | 9/1994 | Sollo . |
| 5,496,245 | 3/1996 | Du Verney . |
| 5,653,665 | 8/1997 | Meeley . |

FOREIGN PATENT DOCUMENTS 7290 11/1899 United Kingdom .

OTHER PUBLICATIONS

L. Simmons, *Chain Reactions: Accomodating Leverages*, Powerlifting USA, Jul. 1996, pp. 26–27, V. 19, No. 12, Powerlifting USA Magazine Co., Camarillo, CA.

*Primary Examiner*—John Mulcahy
*Attorney, Agent, or Firm*—Gerald R. Harmon

[57] ABSTRACT

A device for weight training is attached to a weight lifting apparatus, such as a barbell or a selectorized weight machine, to provide a continuously variable resistance force to the lifting bar of the apparatus. As the power demands of the particular exercise decrease and then increase over an exercise cycle due to the musculoskeletal characteristics of the body, this device provides increasing and then decreasing resistance force to dampen out the variations in the power demands over the exercise cycle. A length of latex tubing intended for a specific exercise can be used to provide the variable resistance force. The latex tubing is connected at one end to the weight lifting apparatus and at the other end to an anchor, such as a platform loaded with weights.

19 Claims, 6 Drawing Sheets

26
16
30
22

72
104
62
96
70
74
94
98
90
78
80
74
96
88
82
80
76
86
94
80
82
99
78
90
82

APPARATUS FOR CONTINUOUSLY VARYING THE RESISTANCE FORCE OF A WEIGHT TRAINING DEVICE

BACKGROUND OF THE INVENTION

1. Technical Field

This invention relates to weight lifting equipment. More particularly, it pertains to a method and apparatus for continuously varying the resistance force exerted by the lifting bar of a weight lifting device.

2. Description of the Prior Art

Generally speaking, there are two types of weight lifting devices in common use today. Each has its own advantages and disadvantages.

One such type is the free-weight barbell. The typical barbell uses a lifting bar with one or more weight plates attached near each end of the bar. The weighted bar is grasped by one or two hands and raised and lowered through an exercise cycle. Some barbells, typically those with a shorter bar, are intended for use primarily for one-handed exercises. These shorter barbells, known as dumbbells, can employ a one-piece construction which combines the lifting bar and weight plates into one piece which prevents varying the fixed weight of the barbell for different exercises for different users. Other barbells, typically those with a longer bar, are intended for use primarily for two-hand exercises. These longer barbells typically employ removable weight plates of various individual weights and means for adding and removing the individual weight plates to and from each end of the bar to vary the fixed weight of the barbell for different exercises and for different users.

The second common type of weight lifting device is the selectorized weight lifting machine which employs a stack of weights channeled for being raised and lowered by a cable and pulleys which connect the stacked weights to a lifting bar. As the lifting bar is raised and lowered through an exercise cycle, a number of the stacked weights, pre-selected by the user for the particular exercise, are raised and lowered. The stacked weights, cable, pulleys and lifting bar are generally interconnected structurally and the path of the lifting bar is typically predefined by the structural connections, unlike the lifting bar of the typical free-weight device which can be moved freely without restriction.

The resistance force of a lifting bar of the more common types of weight lifting devices, against which a user raises and lowers the lifting bar, is fixed and constant through an entire exercise cycle. While benefits of weight lifting with such a fixed and constant resistance force have been well known for many years, the added benefits of weight lifting with a variable resistance force, one which increases as the amount of force required of the body through an exercise cycle decreases and which decreases as the amount of force required of the body through an exercise cycle increases, have become well known more recently.

For weight lifting, power is determined by the amount of force required of a body to move a lifting bar over a prescribed distance in a resultant amount of time. While the time and distance components for determining power remain fairly constant for most exercises, the amount of force required of a body through an exercise cycle will typically vary due to the musculoskeletal features of the body. As a user approaches the midpoint of an exercise cycle, there is typically less difficulty in raising or lowering a lifting bar (i.e. less force required). Conversely, as a user returns to the start and end point of an exercise cycle, there is typically more difficulty (i.e. more force required). Power or strength training to compensate for natural musculoskeletal variations in the amount of required force, with time and distance remaining fixed, involves increasing the resistance force of the lifting bar as the required lifting force decreases in an exercise cycle and decreasing the resistance force of the lifting bar as the required lifting force increases. Power training can permit a user to realize more significant gains in a person's strength and muscle development in a shorter period of time as compared to weight training with a fixed and constant resistance force.

U.S. Pat. No. 5,029,849 discloses an apparatus for varying the resistance force through a defined portion of an exercise cycle. It uses a rather complex series of cords, clips, straps and buckles, in addition to a mechanical type of variable resistance means. The device is intended to apply a variable resistance force through the second step of a defined three-step process of raising and lower a lifting bar. It further discloses means for loosely connecting the apparatus to an end of a lifting bar outside of the weight plates or, presumably, inside the weight plates, assuming the weight plates are removable and the user is inclined to first remove both the weight plates and the means for retaining the weight plates on the lifting bar. This invention further discloses means necessary for physically adjusting the length of the device for physical size differences between individual users.

It is an object of the present invention to provide a variable resistance force to a lifting bar of a weight lifting device throughout a complete exercise cycle. It is a further object of the present invention to provide an apparatus which permits a safe, quick, and easy connection to and removal from the lifting bar of such a device without the need to remove any weight plates. It is a further object of the present invention to provide a device which minimizes the need to adjust the length of the apparatus for physical size differences between individual users. It is yet a further object of the present invention to provide means for allowing a particular user to easily increase the amount of variable resistance force to use for a particular exercise.

SUMMARY OF THE INVENTION

The present invention is a device for continuously varying the resistance force applied to a lifting bar of a weight lifting device through a complete exercise cycle. The device is intended to be used in conjunction with the more common types of weight lifting apparatus: the free-weight barbell, and the selectorized weight lifting machine. The device comprises an elastic cord, which provides a variable resistance force between its ends as it is stretched and returned to its unstretched length, an anchor adapted to receive an anchoring mass, an upper disengagable connector for attaching the top end of the cord to the lifting bar, and a lower disengagable connector for connecting the bottom end of the cord to the anchor. The elastic cord is made to an unstretched length which maintains the cord taut, or slightly stretched, at all times during an exercise cycle. As the distance between the lifting bar and the anchor is increased, the resistance force applied to the lifting bar is increased; as the distance is decreased, the resistance force is decreased. One or two such devices may be attached simultaneously to a lifting bar. Additionally, more than one elastic cord may be connected between one anchor and lifting bar. The device can be used with various types of exercises including the bench press, the curl, and the squat.

One of the purposes of the present invention is to dampen the variations in the power demands during an exercise cycle with a typical weight lifting apparatus by varying the resistance force applied to the lifting bar of a weight lifting device. Additionally, the present invention offers a quick, easy and safe method of attaching to a lifting bar. Further, the present invention provides a device which is capable of use by persons of different physical stature for the same exercise without the need for adjustment. Further, the present invention provides a device where the amount of resistance force may be easily increased by using multiple cords or by using cords of differing elastic characteristics.

DESCRIPTION OF THE PREFERRED EMBODIMENT

Figure 1:
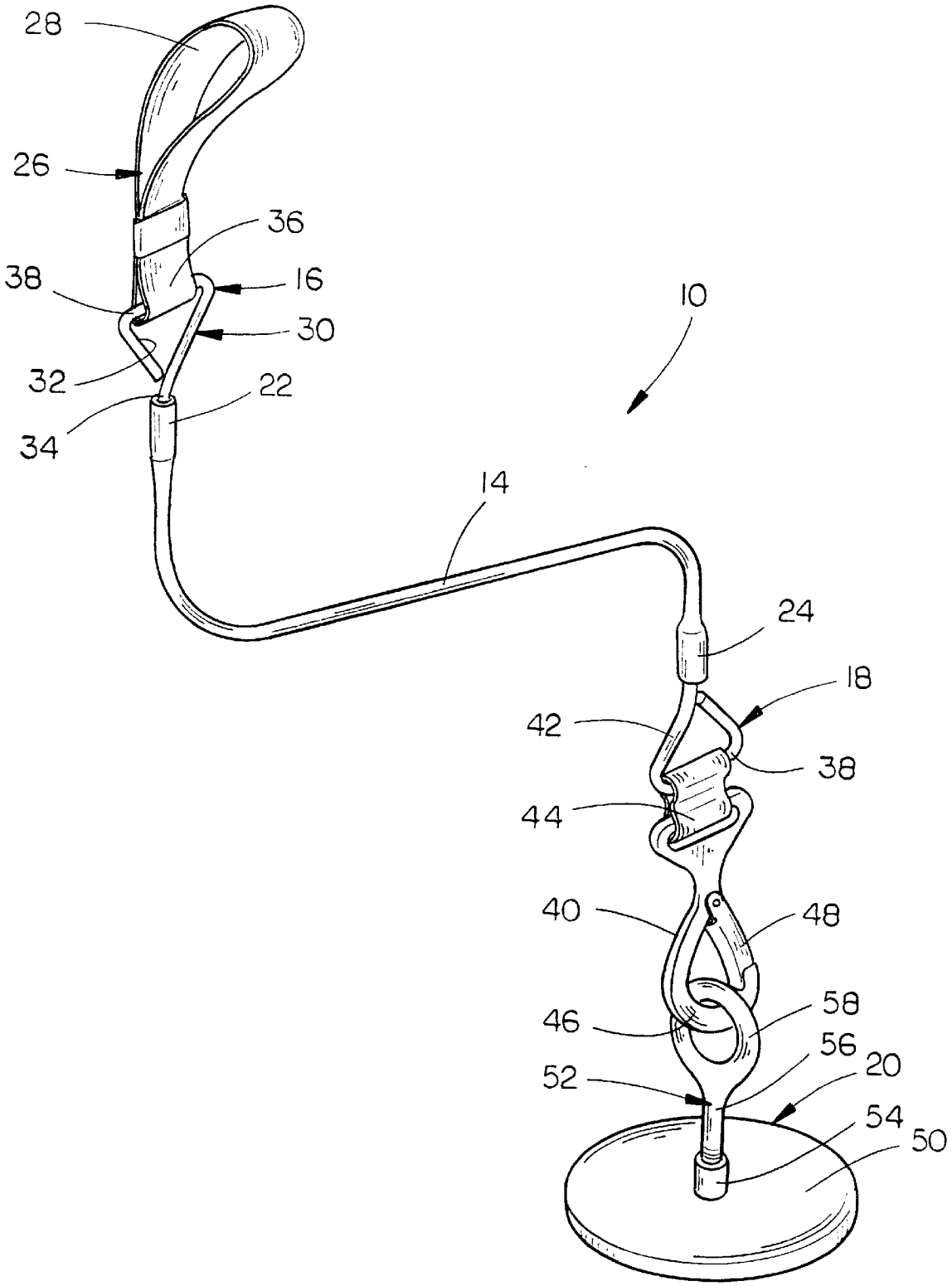
FIG. 1 is a perspective view of one embodiment of the invention.

Reference to the drawings is necessary for a detailed description of the preferred embodiments. Duplicate numbers in the drawing indicate duplicate elements.

Figure 2:
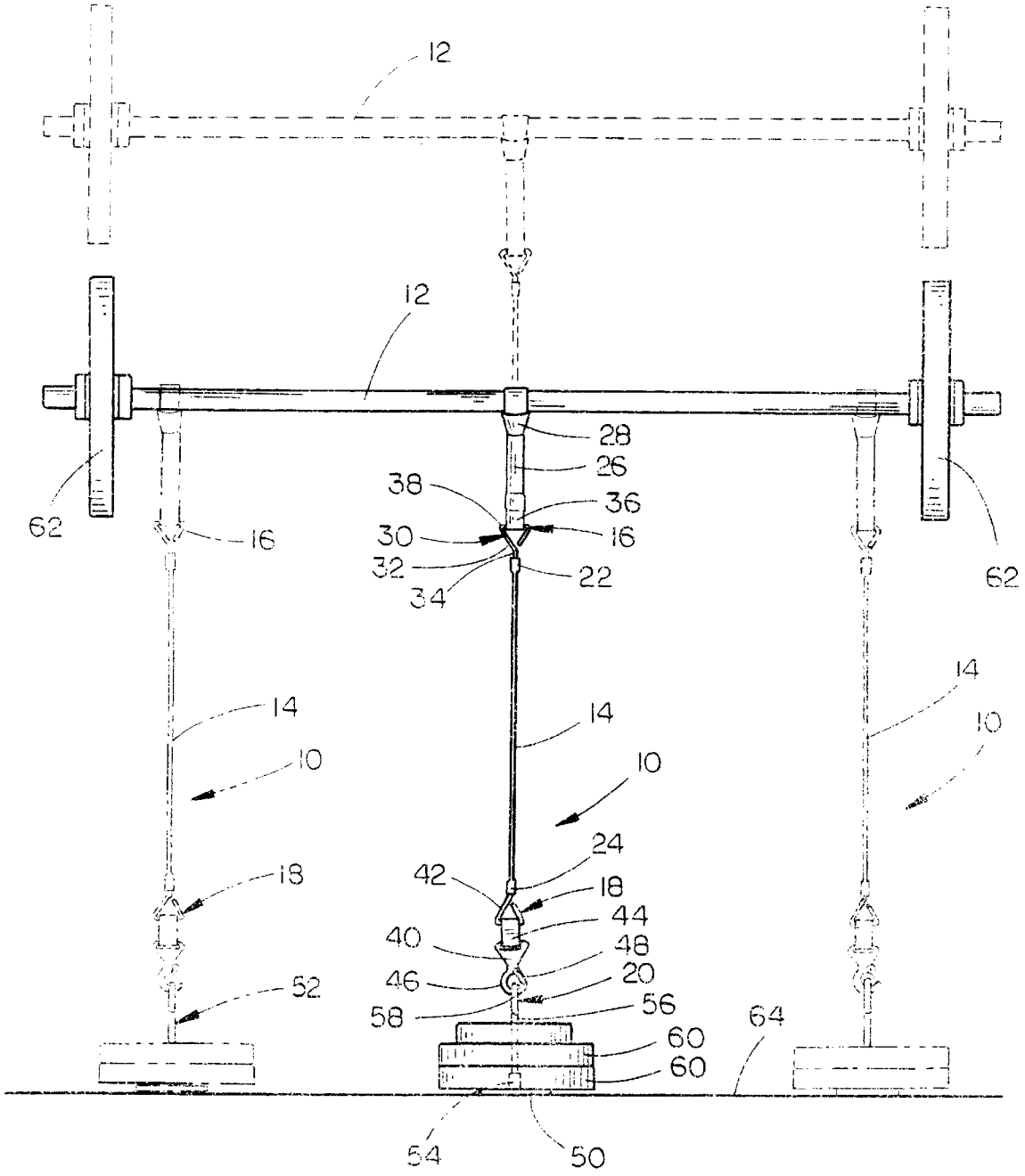
FIG. 2 is a front elevational view of one or a pair of the devices of the invention in association with a lifting bar being raised from the solid line initial position to the dotted line fully raised position.

Referring to FIGS. 1 and 2 of the drawings, one preferred embodiment of a device 10 for continuously applying a variable resistance force to a lifting bar 12 of a weight lifting device is depicted. It comprises an elastic cord 14, an upper disengagable connector 16, a lower disengagable connector 18, and an anchor 20.

The elastic cord 14 has a top end 22 and a bottom end 24. In the preferred embodiment, the elastic cord 14 is composed of latex tubing, although other materials could be used, such as a rubber strap. The material selected should be capable of being stretched to a length substantially greater than its unstretched length without exceeding the elastic limit of the material and the material must provide a resistance force which increases as the elastic cord is stretched and decreases as the elastic cord is returned to its unstretched length. Preferably, the cord 14 should be capable of being stretched to at least two or three times its unstretched length without exceeding its elastic limit. Elastic tubing manufactured by NZ Manufacturing, Inc., of Kent, Washington, and having an inside diameter of ⅛ inch and an outside diameter of 9/16 inch works well. Latex tubing from the same manufacturer having an inside diameter of ⅛ inch and an outside diameter of either ½ inch or ⅝ inch also works well with the ⅝ inch tubing providing a greater resistance force than the 9/16 inch tubing and the ½ inch tubing providing a lesser resistance force than the 9/16 inch tubing.

The unstretched length of the elastic cord 14 is determined by the type of exercise for which the device is to be used. The unstretched length should be such that the cord is taut, or slightly stretched, at all times during an exercise cycle and its longest length during an exercise cycle does not result in the cord exceeding its elastic limit. The unstretched length will typically vary for devices intended for different exercises. For example, for the bench press exercise illustrated in FIGS. 3, 4A and 4B, a cord having an elastic limit which allows the cord to be stretched more than three times its unstretched length could have an unstretched length of approximately ten inches, which unstretched length would permit individuals of different physical stature to use the same cord; while for the squat exercise, the cord could have an unstretched length of approximately sixteen inches, which length would also permit individuals of different physical stature to use the same cord for the squat exercise.

The top end 22 of the elastic cord 14 is attached to the upper disengagable connector 16. The bottom end 24 of the elastic cord 14 is connected to the lower disengagable connector 18.

The upper disengagable connector 16 comprises a first strap 26 having one end folded back upon and joined to the strap 26 to form a first loop 28. The first loop 28 must be large enough to permit the lower disengagable connector 18 and the cord 14 to easily pass through the first loop 28. In the preferred embodiment, the strap 26 is composed of nylon material, although other materials, such as leather, could be used.

An upper cord fastener 30 is used for attaching the strap 26 to the top end 22 of the elastic cord 14. The upper cord fastener 30 has an eyelet 32 and an integral stem 34. The stem 34 has a diameter significantly larger than the inside diameter of the elastic cord 14. The use of a plastic upper cord fastener 30 in conjunction with latex tubing permits easy assembly of the connector 16 to the cord 14 by initially dipping the stem 34 into alcohol immediately before inserting the stem 34 into the top end 22 of the cord 14. The initial use of alcohol in the assembly process causes a bond to form between the latex material of the cord and the plastic of the upper cord fastener 30 making a secure attachment of the upper cord fastener to the top end 22 of the elastic cord 14. The eyelet 32 of the fastener 30 is adapted to having the second end of the strap 26 pass through it and curl back to join the strap to form a second loop 36 through the eyelet 32 of fastener 30. Eyelet 32 forms a generally triangular closure to provide a straight end 38 for engaging the strap 26. One method of joining the first and second ends to the strap 26 is by stitching each end to the strap.

The lower disengagable connector 18 comprises a clasp 40, a second cord fastener 42 and a second strap 44 for joining the clasp 40 to the second cord fastener 42. At one end, the clasp 40 has a hook 46 with a spring loaded locking finger 48, used to prevent the hook from inadvertently disengaging. The second cord fastener 42 is attached to the bottom end 24 of the cord 14 in the same fashion that the upper cord fastener 30 is connected to the top end 22 of the cord 14. The second strap 44 has its opposite ends folded over and stitched or otherwise secured to a center portion of the strap 44 to establish connections to the cord fastener 42 and clasp 40.

In the embodiment depicted in FIGS. 1 and 2, the anchor 20 comprises a platform 50, a weight plate support post 52 and an anchor connection ring 58. The post 52 has a bottom end 54 affixed to the platform 50 in the approximate center and a threaded extension 56 having the anchor connection ring 58 integrally formed with it. The anchor connection ring 58 is capable of passing through the center hole of a standard weight plate, typically 2 inches in diameter for a standard olympic weight plate. The diameter of the post 52 is likewise less than the diameter of the center hole of a standard weight plate 60 to permit the post 52, with the attached anchor connection ring 58, to be inserted into and through the center hole of a standard weight plate 60. The post 52 has a length sufficient to accommodate several standard weight plates 60 being stacked, one upon the other, on top of the platform 50 with the anchor connection ring 58 remaining above the stacked weight plates 60 for receiving the clasp 40 of the lower disengagable connector 18.

Figures 5A, 5B:
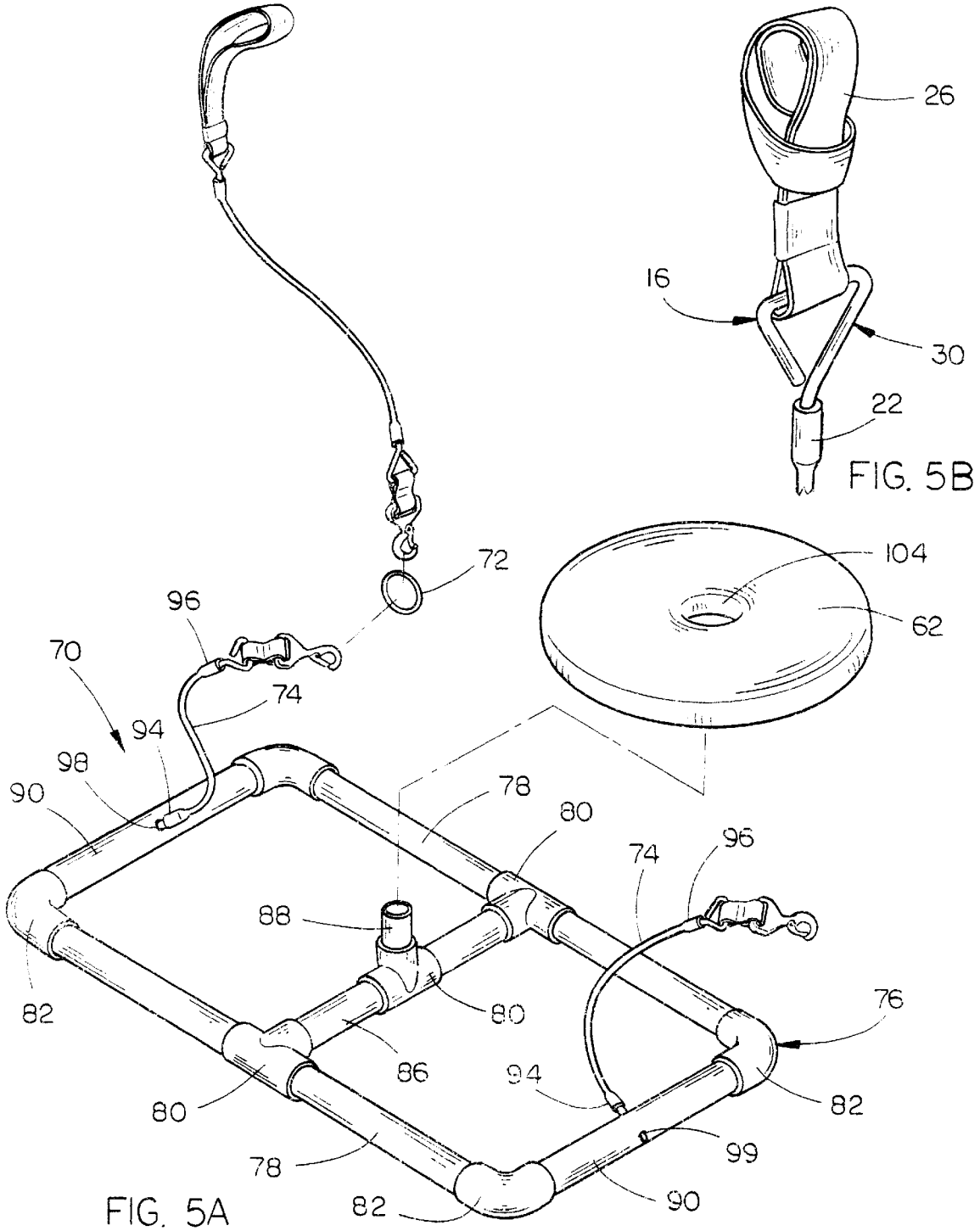
FIG. 5A is a perspective view of an alternate embodiment of the invention including an alternate anchor.
FIG. 5B is a partial perspective view showing the strap of the invention formed in a loop as it would be when secured around a lifting bar.

FIG. 2 illustrates one application of the embodiment of the device depicted in FIG. 1. The upper disengagable connector 16 is connected to the lifting bar 12 between the weight plates 62 at each end of the bar first by disengaging the lower disengagable connector 18 from the anchor 20, second by laying the first loop 28 of the first strap 26 over and partially around the lifting bar 12, third by passing the lower disengagable connector 18 and bottom end 24 of the cord 14 under the lifting bar and through the first loop 28 of the strap 26, thereby encircling the lifting bar with the first strap, and fourth by tightly cinching the first strap 26 around the lifting bar to complete the connection of the top end 22 of the cord 14 to the lifting bar 12. FIG. 5B illustrates an upper disengagable connector 16 attached to the top end 22 of the elastic cord 14 and formed as if to be cinched around a lifting bar, with the lifting bar omitted.

Following connection of the top end 22 of the cord 14 to the lifting bar 12, a sufficient amount of mass is added to the platform 50 of the anchor. The amount of mass to add to the platform 50 is determined by the maximum resistance force applied to the lifting bar 12 by the cord or cords 14 attached to the anchor connection ring 58. The maximum resistance force will be applied when the elastic cord 14 has been stretched to its greatest length for a particular exercise cycle. The maximum resistance force can be expected to vary slightly between individuals of different physical stature. However, a sufficient amount of mass is that amount which, when combined with the mass of the anchor, will significantly exceed the maximum resistance force for that particular individual performing the intended exercise cycle to hold the anchor firmly in place throughout the complete exercise cycle. Accordingly, the anchor 20 remains in stationary engagement with the floor 64 throughout the exercise cycle. One or more weight plates totaling approximately 45 pounds should be sufficient mass for each anchor for the usual exercises when using latex tubing having an inside diameter of ⅛ inch and an outside diameter between ½ inch and ⅝ inch. Following the addition of sufficient mass, i.e. weight plates 60, to the anchor 20, the clasp 40 of the lower disengagable connector 18 is engaged around the anchor connection ring 58, with the locking finger 48 of the clasp safely locked to prevent an inadvertent disengagement of the hook 46.

Figure 3:
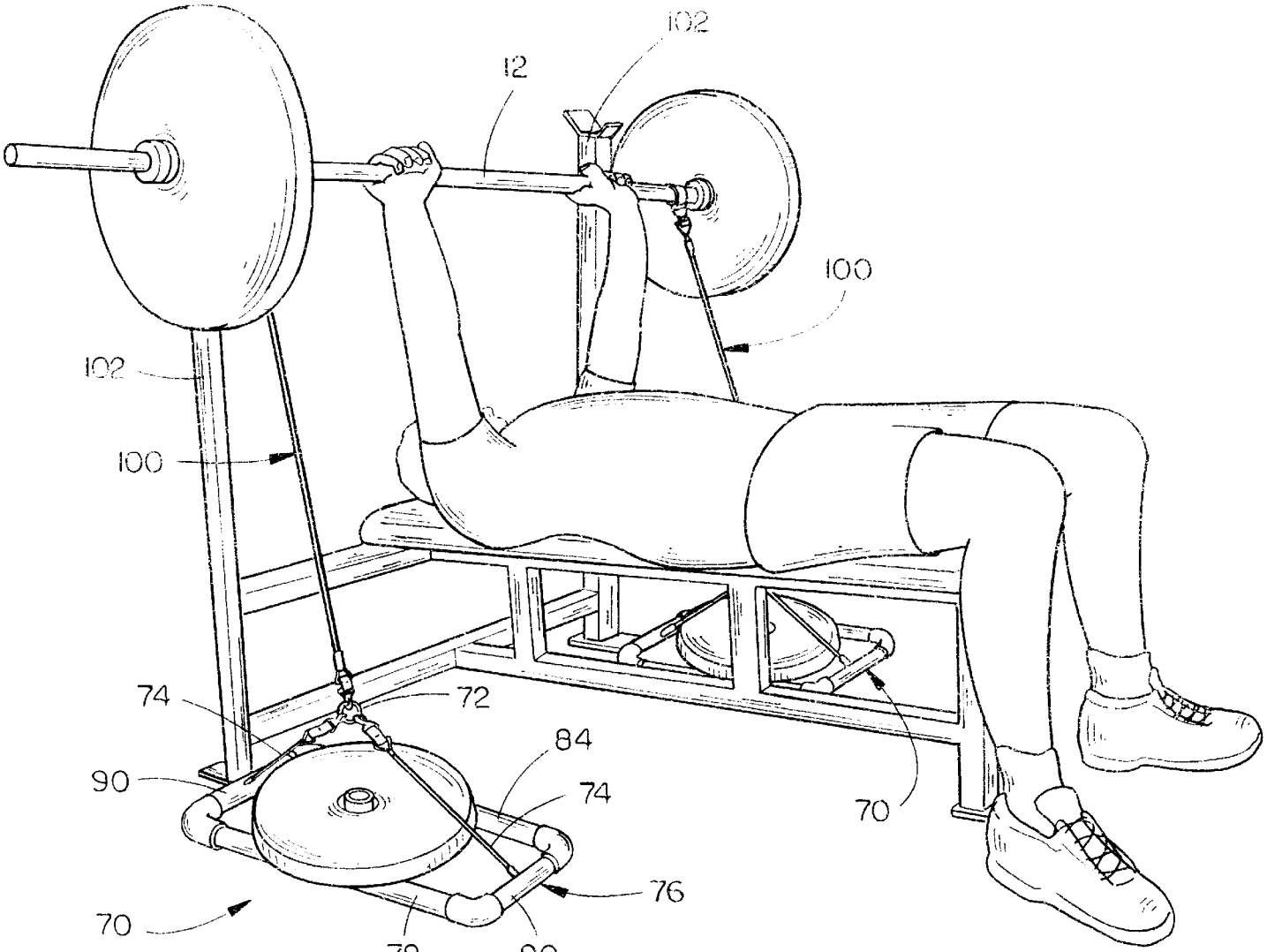
FIG. 3 is a perspective view of a pair of the devices of the invention in use on a lifting bar during a bench press exercise.
Figure 4B:
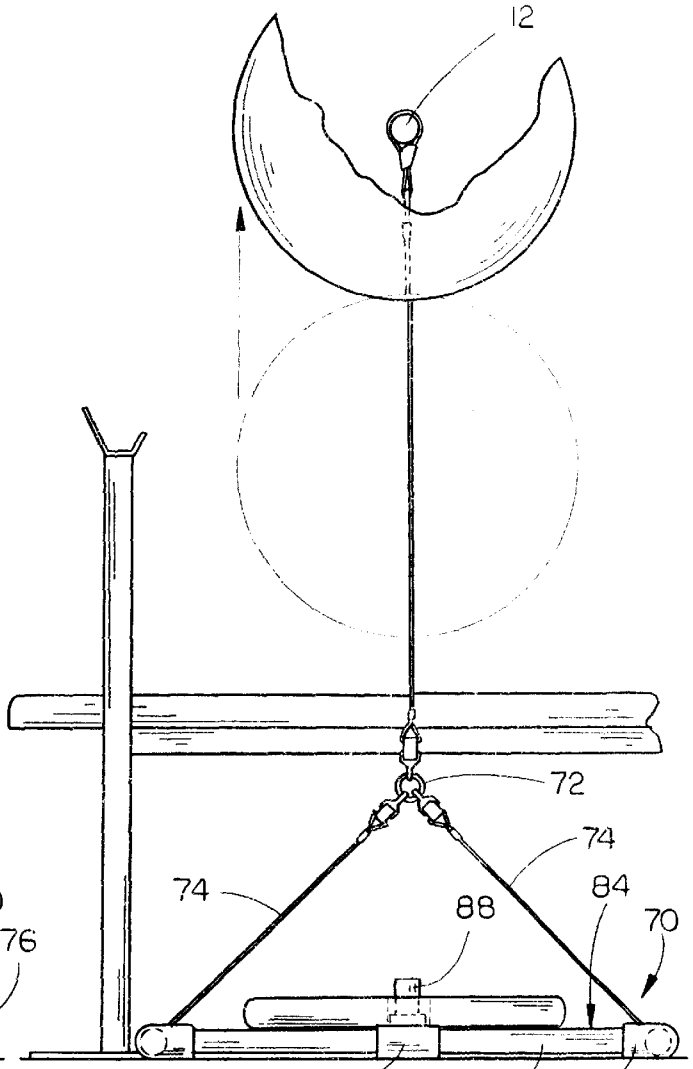
FIG. 4B is a side elevational view of the device of the invention and lifting bar in the fully raised position of the bench press exercise.
Figure 4A:
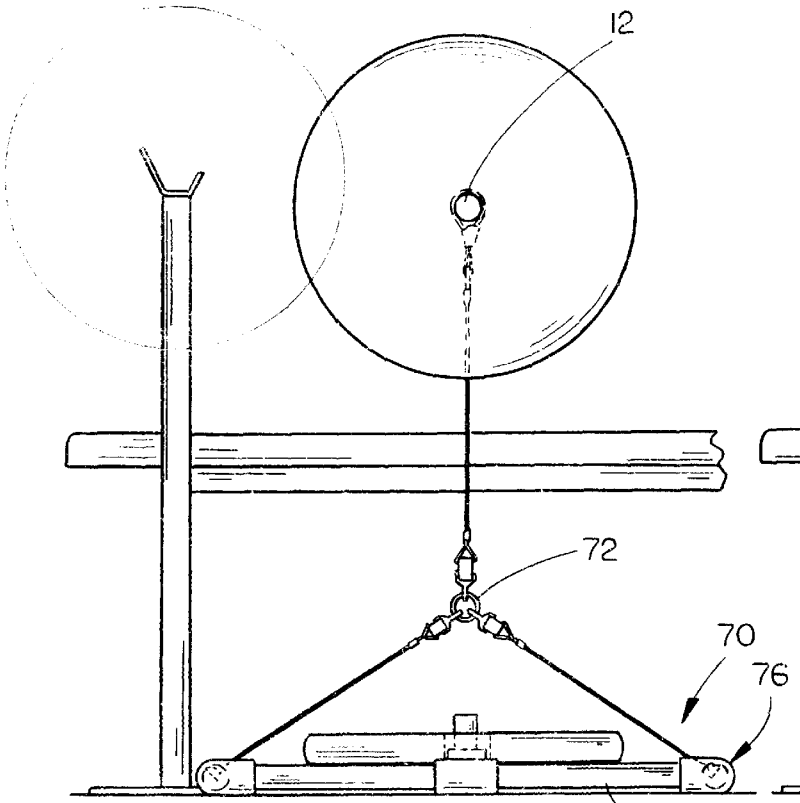
FIG. 4A is a side elevational view of the device of the invention and lifting bar in the initial position of the bench press exercise.

FIGS. 3, 4, and 5A depict an alternate embodiment of the present invention which employs a low profile anchor 70. The low profile anchor comprises an anchor connection ring 72, two or more anchor cords 74 and an anchor platform 76.

The platform 76 of the low profile anchor 70 comprises a series of piping or tubing sections 78 arranged and joined with T-connectors 80 and elbow connectors 82 to form a rectangularly shaped flat surface 84 with a center cross-member 86 joining the approximate midpoints of two opposing sides of the rectangle, the center cross member 86 having a vertical section of piping or tubing 88 projecting upward perpendicular to the flat surface of the rectangle at the approximate midpoint of the cross-member 86. The length of the formed rectangle should be greater than the diameter of the largest weight plate 62 to be added as mass to the anchor. The width of the formed rectangle should be less than the diameter of the smallest weight plate to be added as mass to the anchor 70. PVC piping sections, which are lightweight and easy to work with, are depicted in the embodiment of FIGS. 3 through 5A. A 1¾ inch diameter piping section, or smaller, is preferred for the vertical section 88 to easily permit the vertical section to be inserted into and through the center hole of a standard weight plate 62.

Attached at the approximate midpoint of each of the two shorter sides 90 of the formed rectangle of the platform 76 is one or more elastic anchor cords 74. In the preferred embodiment, each anchor cord 74 is composed of the same type of latex tubing used to form the elastic cord 14, although other materials, such as rubber, could also be used.

Each anchor cord 74 has a platform end 94 and a ring end 96. The ring end 96 of each anchor cord 74 is connected to an anchor connection ring 72; the platform end 94 of each said cord 74 is connected to one of the two shorter sides 90 of the rectangularly formed platform 76, evenly distributing the anchor cords 74 between the two sides 90. The unstretched length of each anchor cord should preferably be such that, with each anchor cord connected between the anchor connection ring and a shorter side of the platform, each anchor cord is taut or slightly stretched.

A disengagable connector 18, comprising a cord fastener 42, a connecting strap 44, and a clasp 40 having a hook 46 and locking finger 48, is used to connect the ring end 96 of each anchor cord 74 to the anchor connection ring 72. An additional cord fastener 42 is used to connect the platform end 94 of each anchor cord 74 to the platform 76, first by forming a hole 98 slightly larger than the diameter of the anchor cord in the piping section 90 at the point of attachment, second by forming a notch or slot 99 in the piping section 90 directly opposite the hole 98, the slot 99 being large enough to permit the cord fastener 42 to pass through one side of the piping section 90 to rest inside the piping section against the opposite side of the piping section, third by inserting the platform end 94 of the anchor cord 74 into and through the formed hole 98 and the formed slot 99, fourth by dipping the stem 34 of the cord fastener 42 in alcohol and immediately inserting it into the platform end 94 of the anchor cord 74, and fifth by retracting the anchor cord 74 through the slot 99 and the hole 98 until the attached cord fastener 42 restricts the anchor cord 74 from being further retracted.

The elastic anchor cords 74 indirectly affect the performance of the elastic cord 14 by allowing the position of the anchor connection ring to move up and down relative to the flat surface of the anchor platform during an exercise cycle, thereby further varying the resistance force applied to the lifting bar by the elastic cord 14 during the exercise cycle. The low profile anchor 70 offers the greatest benefits when used for the bench press exercise where the distance between the lifting bar 12 and the anchor 70 at the beginning of an exercise cycle can typically be quite small. The height of a standard bench used for such an exercise is typically only 16 inches. The low profile anchor 70 permits maximizing the unstretched length of the elastic cord 14 for the bench press exercise. Maximizing the length of the elastic cord 14 for the bench press exercise permits individuals of different physical stature to use the same unstretched length of cord 14 for that same exercise. Additionally, maximizing the length permits the same length of elastic cord 14 to be used for other similar bench type exercises, such as the incline bench press exercise. By use of a low profile anchor, the number of different length elastic cords 14 required for the different types of exercises for which the device can be used and for the different physical statures of the expected users can be minimized. With use of the low profile anchor illustrated in FIGS. 3 through 5A, two standard size elastic cords 14 will permit most, if not all, users of different physical statures to perform most, if not all, of the different types of exercises which involve use of a lifting bar. For bench type exercises (i.e. bench press, incline bench press, etc.), 9/16 inch outside diameter latex tubing having an unstretched length of 10 inches should suffice. For all other type exercises (i.e. curls, squats, etc.), 9/16 inch outside diameter latex tubing having an unstretched length of 16 inches should suffice.

FIG. 3 depicts one application of the present invention for use with the bench press exercise using the anchor depicted in FIGS. 4A through 5A. One device 100 is connected to each end of a lifting bar 12 of a weight loaded barbell, just inside of each set of loaded weight plates 62, with the lifting bar 12 resting on a bench press exercise stanchion 102. The connection of each device 100 to the lifting bar 12 is made in the same fashion and manner as depicted in FIG. 2 and described above. Following connection of the top end 22 of the elastic cord 14 to the lifting bar, a sufficient quantity of anchoring mass is added to the platform 76 by stacking weight plates 62 on the platform 76, one upon the other, with the vertical section of piping 88 of the platform 76 inserted into the center hole 104 (FIG. 5A) of each weight plate 62 to prevent each weight plate from inadvertently slipping off the anchor 70 during an exercise cycle. The ring end 96 of each anchor cord 74 is connected to the anchor connection ring 72 with the hook 46 and locking finger 48 to prevent any such connection from unhooking. The unstretched length of each anchor cord 74 is such that, after the elastic cord 14 has been connected between a lifting bar and the anchor connection ring 72 and all anchor cords 74 have been connected between the anchor connection ring 72 and the shorter platform sides 90 and an anchoring mass 62 has been placed on the anchor platform 76, and the lifting bar is at the lowest point for a particular exercise cycle, the elastic cord 14 and each anchor cord 74 are taut, if not slightly stretched.

Figure 6:
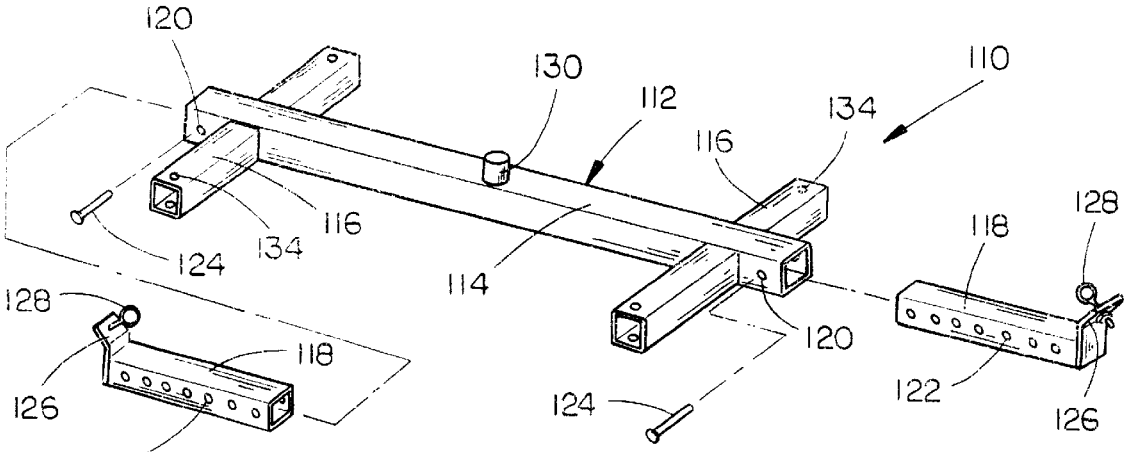
FIG. 6 is an exploded perspective view of a further alternate anchor base of the invention; and, FIG. 7 is a perspective view of an embodiment of the invention including the alternate anchor base of FIG. 6.
Figure 7:
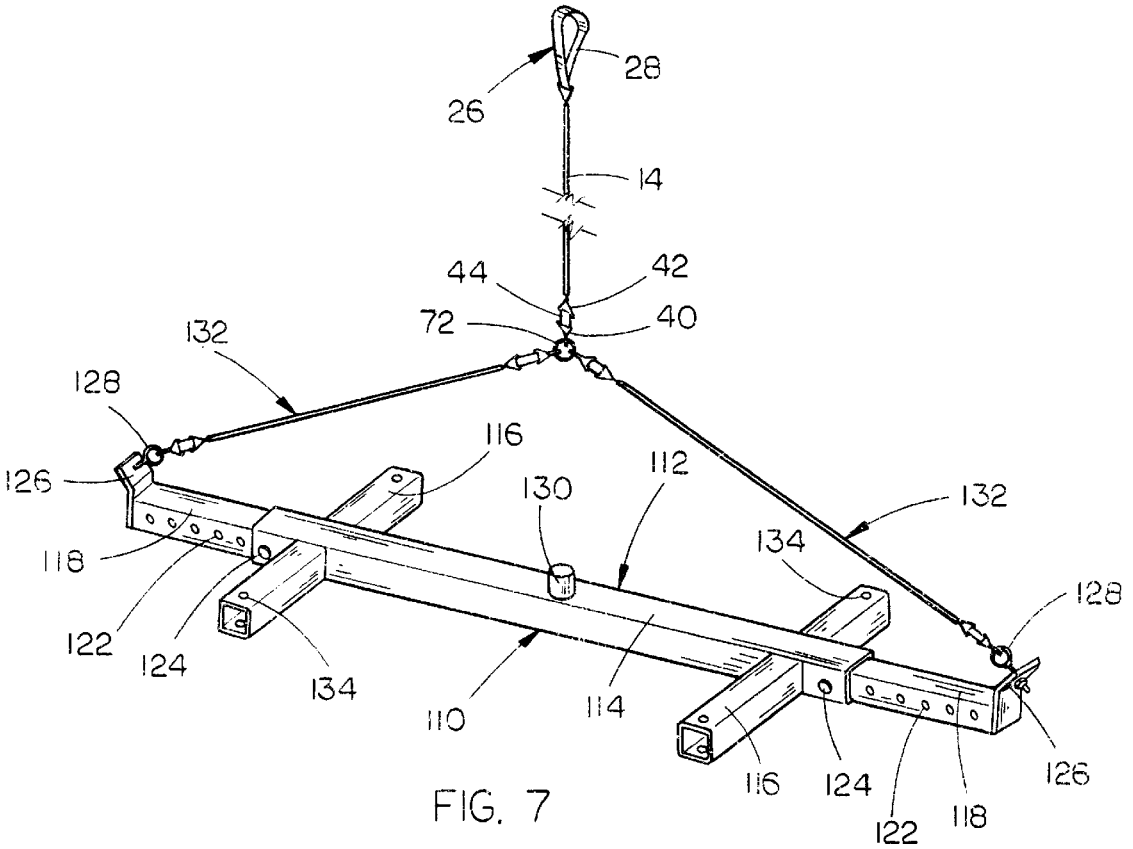

A further embodiment of a low profile anchor 110 is illustrated in FIGS. 6 and 7. Similar to the previously described low profile anchor 70, this further embodiment comprises an anchor connection ring 72, two or more elastic anchor cords 132, and an anchor platform 112.

The platform 112 comprises an elongated base tube 114 and base support tubes 116 extended generally transversely therefrom to stabilize the base tube 114 and to support weight plates that are set thereon. A pair of arms 118 are each telescopically slidably received in a respective end of the base tube 114. To adjustably connect each arm to the base tube 114, each end of the base tube is provided with a transverse hole 120 and each arm 118 is provided with a series of spaced apart arm holes 122. Upon aligning a selected armhole 122 with the base tube end hole 120, a pin fastener 124 may be inserted into the registered holes to lock the arm 118 in place. The free end of each arm 118 has an arm fastener 126 thereon which, in the illustrated embodiment, is a bent flange having an I-bolt 128 secured thereto for attachment of the platform end of one or more anchor cords 132. A weight plate support post 130 is centrally positioned on base tube 114 for positioning and securing weight plates 62 thereon. As an alternative to the use of weight plates, a base support tube hole 134, formed through each support tube, can be used to bolt or screw the platform into a permanent location.

The anchor cords 132 for use with the low profile anchor 110 of FIGS. 6 and 7 are similar to those described in connection with the low profile anchor 70 of FIGS. 3 through 5A. The ring end of each cord 132 is connected to the anchor connection ring 72. The platform end of each cord 132 is connected to an arm fastener 126. In the preferred embodiment, the anchor cords 132 are formed from latex tubing similar to the tubing used to form the elastic cord 14, although other types of elastic materials, such as rubber, could likewise be used. A disengagable connector 18, comprising a cord fastener 42, connecting strap 44, and a clasp 40 having a hook 46 and locking finger 48, is used to connect the ring end of each anchor cord 132 to the anchor connection ring 72. In the preferred embodiment, a disengagable connector 18 is also used to connect the platform end of each anchor cord 132 to an arm fastener. Having a disengagable connector at the platform end of each anchor cord affords greater flexibility in loading and unloading the platform with anchoring mass than a fixed connection at those points, but is not required.

By adjusting the platform arms 118 inward to move the arm fasteners 126 closer to each other, with the anchor cords 132 connected between the arm fasteners and the anchor connection ring, the distance between the anchor connection ring and the anchor platform will be increased before the anchor cords begin to stretch. Adjusting the platform arms outward will decrease that distance before the anchor cords begin to stretch. In this manner, the distance between the lifting bar 12 and the anchor platform 112, before the elastic cord 14 begins to stretch, can also be varied and controlled. This provides greater versatility over the low profile anchor illustrated in FIGS. 3 through 5A with respect to variations in the exercises which might be performed, and with respect to variations in physical statures of persons performing the exercises, without the need to change the unstretched length of the elastic cord 14 being used. The unstretched length of each anchor cord 132 should preferably be such that, with each anchor cord 132 connected between the anchor connection ring 72 and an arm fastener 126 and with the arms 118 adjusted to provide the greatest distance between each arm fastener 126, each anchor cord 132 is taut or slightly stretched.

The present invention contemplates other embodiments in addition to the specific forms depicted in the drawings and described herein. The described and depicted embodiments are intended as illustrative only and are not intended to restrict the embodiments of the present invention. The scope of the invention is indicated by the hereinafter claims, rather than by the limitations of the foregoing specification.

I claim:

1. An apparatus for continuously providing a variable resistance force through an exercise cycle wherein a lifting bar is raised through a lifting distance from an initial height to an intermediate fully raised height and returned to said initial height, comprising:

an elastic cord having a top end, a bottom end, an unstretched length and being stretchable to a length substantially greater than its unstretched length without exceeding its elastic limit and providing a resistance force which increases as the cord is stretched and decreases as the cord is returned to its unstretched length, an upper disengagable connector secured to the top end of the cord for removably attaching the top end of the cord to a lifting bar, an anchor base adapted to receive an anchoring mass, the anchor base comprising a platform for supporting said anchoring mass, a pair of arms connected to and protruding from said platform in opposite directions, each arm including inner and outer ends, a cord fastener adjacent the outer end thereof and a platform fastener operative to secure said arm to said platform at selected positions along each arm whereby the distance between said cord fasteners is adjustable, first and second elastic anchor cords having inner ends connected to one another and outer ends connected to respective cord fasteners of said arms, and a lower disengagable connector secured to the bottom end of the cord for removably attaching the bottom end of the cord to the inner ends of the anchor cords.

2. The apparatus of claim 1 wherein said elastic cord comprises a latex tube.

3. The apparatus of claim 1 wherein the upper disengagable connector comprises a strap having one end folded back upon and joined to itself to form a loop of a size for passage of the lower disengagable connector and said elastic cord through said loop, and an upper cord fastener connecting said strap to the top end of the cord whereby, said loop may be placed over and partially around a lifting bar and said cord and attached lower disengagable connector passed below the lifting bar and through said loop, and said elastic cord pulled downwardly to tightly cinch said loop around the lifting bar.

4. The apparatus of claim 3 wherein said upper cord fastener comprises an eyelet secured to said strap and an integral stem protruding from said eyelet and secured to said elastic cord.

5. The apparatus of claim 4 wherein said elastic cord comprises a latex tube and said integral stem of said upper cord fastener is inserted into and secured to one end of said latex tube.

6. The apparatus of claim 1 wherein said elastic cord comprises a latex tube which, in its unstretched length, has an outside diameter greater than ⅜" and an inside diameter greater than 1/16".

7. The apparatus of claim 1 wherein said platform comprises an elongated base tube and anchor base support tubes extended generally transversely therefrom, each arm comprising a tube telescopically slidably received within said base tube.

8. The apparatus of claim 7 wherein said anchor cords are of a length such that the combined unstretched lengths of said anchor cords is not substantially greater than the distance between said cord fasteners with said arms adjusted to provide the maximum distance between the said cord fasteners.

9. The apparatus of claim 7 wherein each platform fastener comprises coacting holes through said base tube and arms and a pin fastener removably extended through registered holes in said base tube and respective arm.

10. The apparatus of claim 9 further comprising a weight plate support post connected to and extended upwardly from said base tube.

11. The apparatus of claim 1 wherein each anchor cord comprises a latex tube, a pair of tube fasteners secured to respective ends of said tube, a pair of clasps, and a pair of straps, each strap connecting a clasp to a respective tube fastener.

12. The apparatus of claim 11 further comprising a ring to which a clasp of each anchor cord is connected.

13. An apparatus for continuously providing a variable resistance force through an exercise cycle wherein a lifting bar is raised through a lifting distance from an initial height to an intermediate fully raised height and returned to said initial height, comprising:

an elastic cord having a top end, a bottom end, an unstretched length and being stretchable to a length substantially greater than its unstretched length without exceeding its elastic limit and providing a resistance force which increases as the cord is stretched and decreases as the cord is returned to its unstretched length, an upper disengagable connector secured to the top end of the cord for removably attaching the top end of the cord to a lifting bar, a lower disengagable connector secured to the bottom end of the cord, an anchor base adapted to receive one or more weight plates having center holes, said anchor base having a defined perimeter and comprising a platform formed by a plurality of structural members arranged to form a flat surface and a weight plate support post having one end affixed to the platform and further comprising a plurality of elastic anchor cords connecting said lower disengagable connector to said anchor base, said anchor cords being connected to said anchor base adjacent its perimeter at spaced apart locations.

14. The apparatus of claim 13 wherein said elastic anchor cords are of generally equal lengths and are connected to the anchor base at locations to balance and evenly distribute between the anchor cords the resistance force exerted by the said elastic cord upon raising of the lifting bar.

15. The device of claim 14 wherein each elastic anchor cord has an unstretched length and is capable of being stretched to a length substantially greater than its unstretched length without exceeding its elastic limit and of providing a resistance force which increases as the anchor cord is stretched and decreases as the anchor cord is returned to its unstretched length.

16. The apparatus of claim 15 wherein each anchor cord comprises a latex tube which, in its unstretched length, has an outside diameter greater than ⅜ inches and an inside diameter greater than 1/16 inch.

17. An apparatus for continuously providing a variable resistance force through an exercise cycle, comprising:

a lifting bar operative to be raised through a lifting distance from an initial height to an intermediate fully raised height and returned to said initial height, an elastic cord having a top end, a bottom end, an unstretched length and being stretchable to a length substantially greater than its unstretched length without exceeding its elastic limit and providing a resistance force which increases as the cord is stretched and decreases as the cord is returned to its unstretched length, an upper disengagable connector secured to the top end of the cord for removably attaching the top end of the cord to a lifting bar, an anchor, and a lower disengagable connector secured to the bottom end of the cord, the anchor comprising one or more weight plates having a center opening and functioning as an anchoring mass for said anchor and an anchor base comprising a weight plate receiving platform including an upstanding weight plate support post for securing said one or more weight plates on said platform, said anchor base having a defined perimeter and further comprising a plurality of elastic anchor cords connecting said lower disengagable connector to said anchor base, said anchor cords being connected to said anchor base adjacent its perimeter at spaced apart locations.

18. The apparatus of claim 17 wherein said elastic anchor cords are of generally equal lengths and are connected to the anchor base at locations to balance and evenly distribute between the anchor cords the resistance force exerted by the elastic cord upon raising of the lifting bar.

19. The apparatus of claim 18 wherein each elastic anchor cord has an unstretched length and is capable of being stretched to a length substantially greater than its unstretched length without exceeding its elastic limit and of providing a resistance force which increases as the anchor cord is stretched and decreases as the anchor cord is returned to its unstretched length.

* * * * *